US010941507B2

(12) United States Patent
Iuchi et al.

(10) Patent No.: US 10,941,507 B2
(45) Date of Patent: Mar. 9, 2021

(54) STRETCHABLE MEMBER FOR SHOE AND SHOE INCLUDING THE STRETCHABLE MEMBER

(71) Applicant: Mizuno Corporation, Osaka (JP)

(72) Inventors: Kazunori Iuchi, Osaka (JP); Kohei Yamada, Osaka (JP)

(73) Assignee: Mizuno Corporation, Osaka (JP)

( * ) Notice: Subject to any disclaimer, the term of this patent is extended or adjusted under 35 U.S.C. 154(b) by 296 days.

(21) Appl. No.: 15/937,500

(22) Filed: Mar. 27, 2018

(65) Prior Publication Data

US 2018/0279720 A1 Oct. 4, 2018

(30) Foreign Application Priority Data

Mar. 28, 2017 (JP) ..... 2017-063299

(51) Int. Cl.

| | |
|---|---|
| ***D04B 1/24*** | (2006.01) |
| ***A43B 23/02*** | (2006.01) |
| ***D04B 21/20*** | (2006.01) |
| ***A43B 13/04*** | (2006.01) |
| ***D04B 21/18*** | (2006.01) |

(Continued)

(52) U.S. Cl.

CPC ..... *D04B 1/24* (2013.01); *A43B 1/04* (2013.01); *A43B 13/04* (2013.01); *A43B 23/027* (2013.01); *D04B 1/18* (2013.01); *D04B 21/18* (2013.01); *D04B 21/207* (2013.01); *A43B 23/021* (2013.01); *A43B 23/0215* (2013.01); *D10B 2403/0113* (2013.01); *D10B 2501/043* (2013.01)

(58) Field of Classification Search

CPC .. D04B 1/123; D04B 1/24; A43B 1/04; A43B 23/045; A43B 23/047

See application file for complete search history.

(56) References Cited

U.S. PATENT DOCUMENTS 4,438,574 A * 3/1984 Johnson ..... A43B 23/0235 36/129
4,813,158 A * 3/1989 Brown ..... A43B 5/00 36/114

(Continued)

FOREIGN PATENT DOCUMENTS

DE 102015116398 A1 3/2017
JP 2006000258 A 1/2006

(Continued)

OTHER PUBLICATIONS

Japanese Office Action issued in related Japanese Application No. 2017-063299 dated Oct. 9, 2018.

*Primary Examiner* — Danny Worrell

(74) *Attorney, Agent, or Firm* — Troutman Pepper Hamilton Sanders LLP; James E. Schutz; Micah B. Hensley

(57) ABSTRACT

A stretchable member includes: a flat base made of a stretchable knitted fabric; and a limiting part extending in a stretching direction of the base, formed integrally with the base while having both ends in a length direction knitted in, and fixed to, the base, and configured to limit stretch of the base. The limiting part is longer than the distance between fixing points at which the limiting part is fixed to the base in an unstretched state, and is made of a knitted fabric which has a flat band shape and which is configured to become slack with respect to the base when the base is in the unstretched state.

15 Claims, 8 Drawing Sheets

(51) Int. Cl.
*D04B 1/18* (2006.01)
*A43B 1/04* (2006.01)

(56) References Cited

U.S. PATENT DOCUMENTS

| | | | | | |
|---|---|---|---|---|---|
| 5,671,482 | A * | 9/1997 | Alvera | A41B 11/02 | 139/383 R |
| 5,826,277 | A * | 10/1998 | McConville | A41D 20/00 | 2/171 |
| 5,963,988 | A * | 10/1999 | Jackson, Jr. | A41F 9/025 | 139/422 |
| 6,401,364 | B1 * | 6/2002 | Burt | A43B 1/00 | 36/3 A |
| 7,810,359 | B2 * | 10/2010 | Hannula | A61B 5/6814 | 66/172 E |
| 7,882,713 | B2 * | 2/2011 | Tseng | D04B 1/18 | 66/172 E |
| 8,800,172 | B2 * | 8/2014 | Dua | A43B 23/0275 | 36/50.1 |
| 2012/0255201 | A1 * | 10/2012 | Little | A43B 1/04 | 36/84 |
| 2015/0059209 | A1 | 3/2015 | Dekovic et al. | | |
| 2016/0058099 | A1 | 3/2016 | Panian et al. | | |
| 2016/0174660 | A1 | 6/2016 | Iuchi et al. | | |
| 2016/0366979 | A1 * | 12/2016 | Bell | A43B 1/04 | |
| 2018/0042333 | A1 * | 2/2018 | Manos-Gully | A43B 1/04 | |

FOREIGN PATENT DOCUMENTS

| | | | |
|---|---|---|---|
| JP | 2015-66280 | A | 3/2015 |
| WO | 2016205342 | A1 | 12/2016 |

* cited by examiner

STRETCHABLE MEMBER FOR SHOE AND SHOE INCLUDING THE STRETCHABLE MEMBER

CROSS-REFERENCE TO RELATED APPLICATION

This application claims priority to Japanese Patent Application No. 2017-063299 filed on Mar. 28, 2017, the entire disclosure of which is incorporated by reference herein.

BACKGROUND

The present disclosure relates to a stretchable member for a shoe and a shoe including the stretchable member.

Shoes of the known art include a reinforcing member (stretchable member) arranged in a predetermined portion of its upper. For example, Japanese Unexamined Patent Publication No. 2015-066280 proposes shoes of this type.

Specifically, the shoes disclosed in Japanese Unexamined Patent Publication No. 2015-066280 include an upper which is provided with a base knit fabric made of a fabric of knitted texture. A plurality of float stitch knitted yarns (fiber reinforcing portions) are provided integrally with a predetermined portion of the base knit fabric. This configuration allows the fabric of knitted texture to stretch suitably to allow the upper to fit a foot. In addition, when the fabric of knitted texture stretches to an appropriate extent, a tension of the float stitch knitted yarns increases to allow the upper to hold a predetermined portion of the foot.

SUMMARY

The upper disclosed in Japanese Unexamined Patent Publication No. 2015-066280 allows a person wearing the shoes (hereinafter referred to as the "wearer") to feel that the shoes fit and hold his/her feet. However, the float stitch knitted yarns are formed integrally with the base knit fabric, while skipping one to ten loops, and loop portions of the float stitch knitted yarns are exposed outside from the base knit fabric. Therefore, the loop portions of the float stitch knitted yarns may be easily caught on obstacles including a toe and a toenail of a wearer. If the loop portions are caught on such an obstacle, the upper itself may be tore, making the fitting properties of the shoes insufficient. In addition, a single thread itself, which forms part of each float stitch knitted yarn, has a relatively low tensile stress. Therefore, simply arranging the float stitch knitted yarn (the fiber reinforcing portions described above) cannot limit the stretch of the base knit fabric suitably, nor maintain the holding properties of the shoes sufficiently.

In view of the foregoing background, it is therefore an object of the present disclosure to improve fitting properties and holding properties of shoes.

To achieve the above object, a first aspect of the present disclosure is directed to a stretchable member usable for an upper of a shoe. The stretchable member includes: a flat base made of a stretchable knitted fabric; and a limiting part extending in a stretching direction of the base, formed integrally with the base while having both ends in a length direction knitted in, and fixed to, the base, and configured to limit stretch of the base. The limiting part is longer than a distance between fixing points at which the limiting part is fixed to the base in an unstretched state, and is made of a knitted fabric which has a flat band shape and which is configured to become slack with respect to the base when the base is in the unstretched state.

In the first aspect, the limiting part is longer than the distance between fixing points at which the limiting part is fixed to the base in the unstretched state, and is configured to become slack with respect to the base when the base is in the unstretched state. That is, the limiting part permits the base to stretch by a predetermined amount from the unstretched state. As a result, when a wearer puts on shoes of which the upper includes the stretchable member, the base stretches by the predetermined amount from the unstretched state, which makes it easy for the shoes to fit the feet of the wearer. On the other hand, the limiting part limits the stretch of the base. As a result, the wearer's feet are not allowed to move or slide excessively inside the shoes, and are kept held in the shoes. The limiting part is made of a knitted fabric having a flat band shape and is formed integrally with the base. This configuration makes it less likely that the limiting part is caught on obstacles and the like, and increases the tensile stress of the stretchable member. Thus, the limiting part is kept slack with respect to the base in the unstretched state, resulting in that the stretchable member enables the shoes to maintain the fitting properties. In addition, the limiting part strongly limits the stretch of the base, resulting in that the stretchable member enables the shoes to have improved holding properties. Therefore, the stretchable member according to the first aspect can improve the fitting properties and the holding properties of the shoes.

A second aspect of the present disclosure is an embodiment of the first aspect. In the second aspect, the limiting part has a width of 1 mm or more.

Specifically, according to the second aspect, the limiting part is designed to have a width equal to or greater than a gap between a toenail and the underlying skin (i.e., 1 mm). This configuration substantially prevents the limiting part from entering between a toenail and the underlying skin, and can increase the tensile stress of the stretchable member sufficiently.

A third aspect of the present disclosure is an embodiment of the first aspect. In the third aspect, the limiting part includes a plurality of limiting parts, and ends of each of the plurality of limiting parts are joined to ends of adjacent ones of the plurality of limiting parts at associated ones of fixing points at which the plurality of limiting parts are fixed to the base, such that the plurality of limiting parts, which are joined to each other in series, form at least one continuous row in the stretching direction of the base.

According to the third aspect, the ends of each of the plurality of limiting parts are joined to ends of adjacent ones of the plurality of limiting parts at associated ones of fixing points at which the plurality of limiting parts are fixed to the base, and the plurality of limiting parts, which are thus joined to each other in series, form at least one continuous row in the stretching direction of the base. This configuration increases the tensile stress of the stretchable member uniformly in the stretching direction.

A fourth aspect of the present disclosure is an embodiment of the third aspect. In the fourth aspect, the row of the plurality of limiting parts includes a plurality of rows of the plurality of limiting parts, and the plurality of rows of the plurality of limiting parts are arranged side by side at intervals in a direction perpendicular to the stretching direction of the base.

According to the fourth aspect, the plurality of rows of the plurality of limiting parts are arranged side by side at intervals in a direction perpendicular to the stretching direction of the base. Thanks to this configuration, portions of the base between the plurality of rows of the plurality of limiting parts can stretch also in the direction perpendicular to the stretching direction of the base, without being limited by the limiting parts. Thus, this configuration contributes to further improvement of the fitting properties of the shoes.

A fifth aspect of the present disclosure is an embodiment of the first aspect. In the fifth aspect, the limiting part is made of a knitted fabric which is less stretchable than the base.

According to the fifth aspect, the limiting part is made of a knitted fabric which is less stretchable than the base. This makes it possible to increase the tensile stress of the limiting part relative to that of the base. As a result, the limiting part can reliably limit the stretch of the base.

A sixth aspect of the present disclosure is an embodiment of the first aspect. In the sixth aspect, a plurality of holes which are deformable in accordance with the stretch and contraction of the base are formed in the base to be spaced apart from each other.

According to the sixth aspect, the plurality of holes that are deformable in accordance with the stretch and contraction of the base are formed to be spaced apart from each other. This configuration facilitates the stretch of the base, and contributes to further improvement of the fitting properties of a shoe.

A seventh aspect of the present disclosure is directed to a shoe including the stretchable member of any one of the first to sixth aspects provided in a portion, of an upper, corresponding to a forefoot of a wearer.

The shoe according to the seventh aspect can bring about an effect equivalent to those of the first to sixth aspects to the forefoot in a concentrated manner.

An eighth aspect of the present disclosure is directed to a shoe including the stretchable member of any one of the first to sixth aspects provided in a portion, of an upper, corresponding to a midfoot of a wearer.

The shoe according to the eighth aspect can bring about an effect equivalent to those of the first to sixth aspects to the midfoot in a concentrated manner.

As can be seen from the foregoing, the present disclosure can improve the fitting properties and the holding properties of shoes.

DETAILED DESCRIPTION

An embodiment of the present disclosure will now be described in detail with reference to the drawings. Note that the following description of the embodiment is merely an example in nature, and is not intended to limit the scope, application, or uses of the present disclosure.

Figure 1:
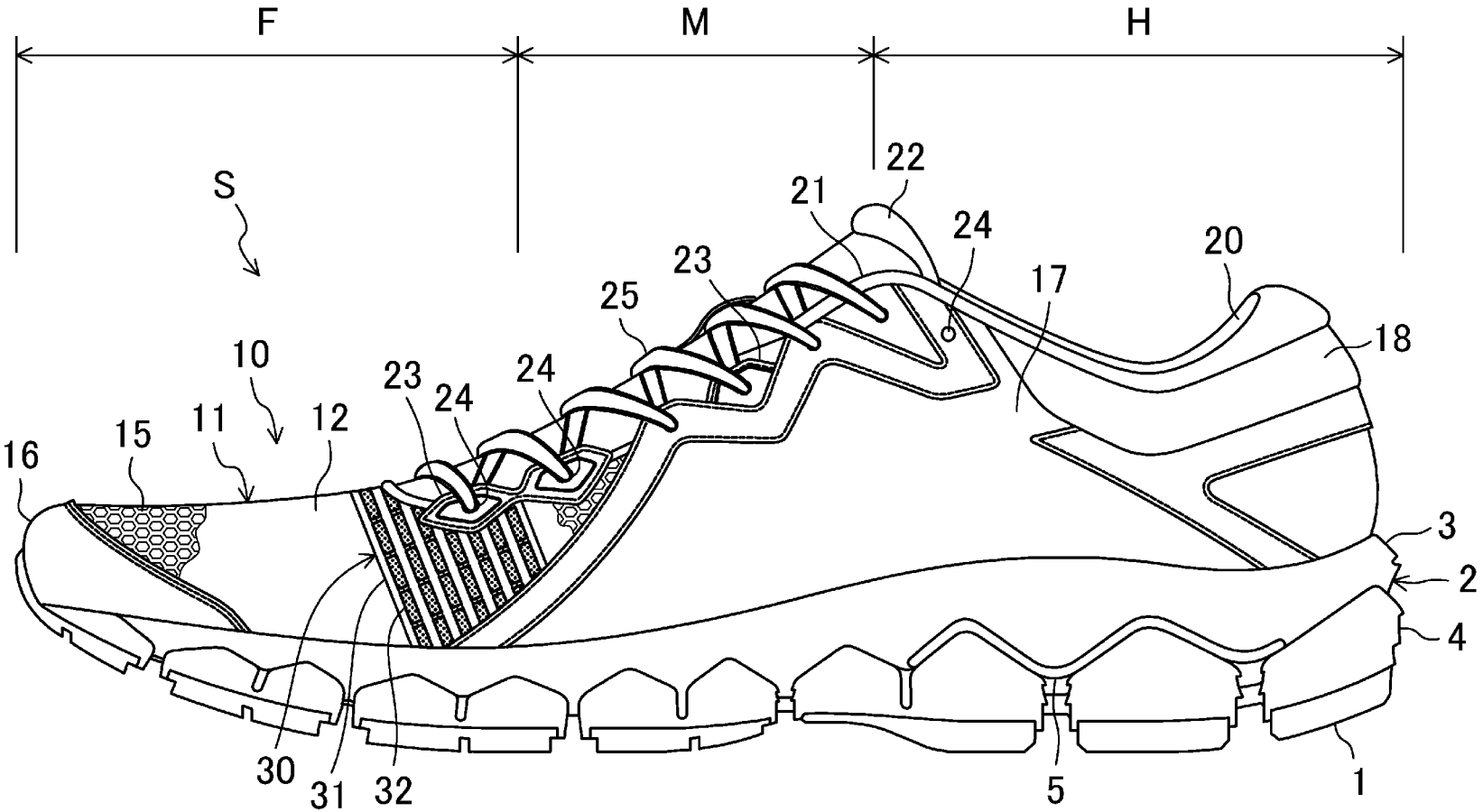
FIG. 1 is a side view of a shoe according to an embodiment of the present disclosure, as viewed from the lateral side.

FIG. 1 illustrates a whole structure of a shoe S according to an embodiment of the present disclosure. A pair of shoes S may be used, for example, as athletic shoes for running and various sports, sneakers for daily use, or rehabilitation shoes.

The drawings illustrate a left shoe S only as an example Since the right shoe is symmetrical to the left shoe, only the left shoe will be described in the following description, and the description of the right shoe will be omitted herein.

In the following description, the expressions "above," "upward," "on a/the top of," "below," "under," and "downward," represent the vertical positional relationship between respective components of the shoe S. The expressions "front," "fore," "forward," "anterior," "rear," "hind," "behind," "backward," and "posterior" represent the positional relationship in the longitudinal direction between respective components of the shoe S. The expressions "medial side" and "lateral side" represent the positional relationship in the foot width direction between respective components of the shoe S.

As illustrated in FIG. 1, the shoe S includes an outsole 1 which extends from a forefoot F to a hindfoot H of a foot of a person wearing the shoe S (hereinafter referred to as the "wearer"). The outsole 1 is made from a hard elastic material which is harder than the material for a midsole 2, which will be described later. Examples of suitable materials for the outsole 1 include, but not are limited to, thermoplastic resins such as ethylene-vinyl acetate copolymer (EVA), thermosetting resins such as polyurethane (PU), and rubber materials such as butadiene rubber and chloroprene rubber. The outsole 1 has, on its lower surface, a ground surface configured to touch the ground.

The shoe S includes the midsole 2 which supports a plantar surface of the wearer, from the forefoot F to the hindfoot H. The midsole 2 is made of a soft elastic material. Non-limiting suitable examples of the material for the midsole 2 include thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials. The midsole 2 is stacked on the outsole 1, while having a lower portion thereof bonded to an upper portion of the outsole 1 with an adhesive or other means. The midsole 2 is divided into portions arranged in the vertical direction. Specifically, the midsole 2 is a multilayer including an upper midsole 3 and a lower midsole 4 stacked below the upper midsole 3.

A corrugated plate 5 is disposed between the upper and lower midsoles 3 and 4 such that the corrugated plate 5 corresponds to the hindfoot H of the foot. The corrugated plate 5 has a corrugated shape having peaks and valleys alternating with each other in the longitudinal direction.

As illustrated in FIG. 1, an upper 10 configured to cover the wearer's foot is attached to the peripheral edge of the upper midsole 3. The upper 10 includes an upper body 11 configured to cover the wearer's foot from the tiptoe of the forefoot F to the rear side of the heel of the hindfoot H.

Figure 2:
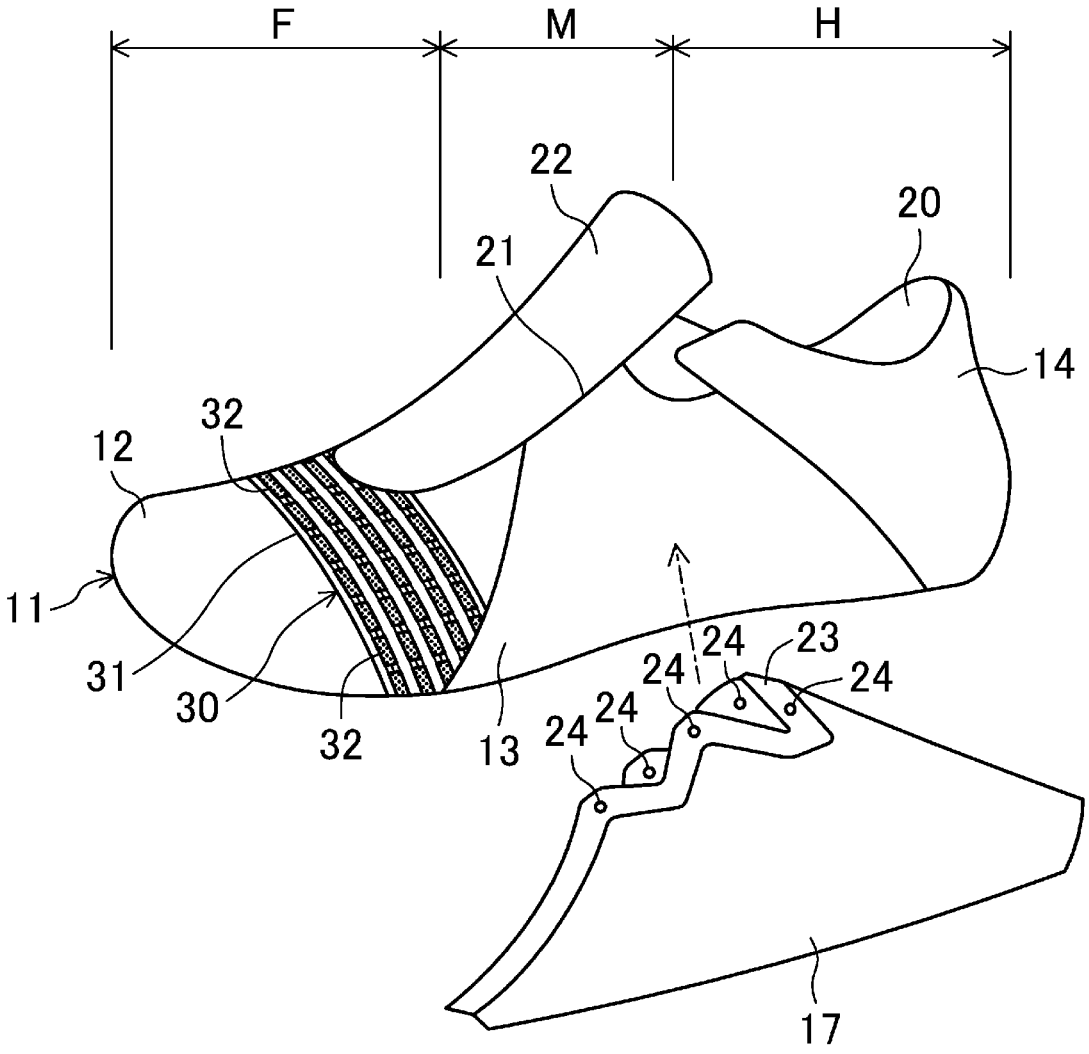
FIG. 2 is a perspective view of the structure of a portion of an upper, as viewed from the lateral side.

As illustrated in FIG. 2, the upper body 11 includes a forefoot base member 12, two midfoot base members 13, and a hindfoot base member 14. The base members 12, 13, and 14 have respective lower edges bonded integrally to the entire peripheral edge of the upper midsole 3 with an adhesive or other means. Each of the base members 12, 13, and 14 is preferably made of a stretchable material. Specifically, examples of materials for each of the base members 12, 13, and 14 include, but are not limited to, double-raschel warp knitted fabrics, mesh materials, synthetic leather, artificial leather, and natural leather.

As illustrated in FIG. 2, the forefoot base member 12 is arranged to correspond to an upper portion, a medial side, and a lateral side of the forefoot F of the foot. An upper surface of the forefoot base member 12 is provided with an exterior member 15 made of a mesh material. The exterior member 15 is arranged above the forefoot base member 12 such that the exterior member 15 is overlaid on a stretchable member 30, which will be described later (see, FIG. 3). As illustrated in FIG. 1, a tiptoe-reinforcing part 16 which has a substantially arc shape is provided to extend in the foot width direction along the front end (which corresponds to the tiptoe of the foot) of each of the forefoot base member 12 and the exterior member 15. The tiptoe-reinforcing part 16 is made of, for example, artificial leather, and fixed to the forefoot base member 12 and the exterior member 15 by sewing or other means. Note that FIG. 1 illustrates only a portion of the exterior member 15 to show the stretchable member 30 which will be described later.

As illustrated in FIG. 2, the midfoot base member 13 is arranged to correspond to a lateral side of the midfoot M, and has a front end sewn to the rear end of the forefoot base member 12. As illustrated also in FIG. 1, the midfoot base member 13 is provided with a side-reinforcing part 17 covering the entire surface of the midfoot base member 13. The side-reinforcing part 17 is made of, for example, artificial leather, and fixed to the peripheral edge of the midfoot base member 13 by sewing or other means. Note that although FIGS. 1 and 2 only show the midfoot base member 13 and the side-reinforcing part 17 that are arranged at the lateral side, another midfoot base member 13 and another side-reinforcing part 17 are arranged at the medial side, just like the lateral side.

As illustrated in FIG. 2, the hindfoot base member 14 is arranged to correspond to a rear side, a medial side, and a lateral side of the hindfoot H, and has a front end sewn to the rear end of each of the midfoot base members 13. As illustrated in FIG. 1, the hindfoot base member 14 is provided with a heel-reinforcing part 18 which is curved to cover the rear side of the heel of the foot. The heel-reinforcing part 18 is made of, for example, artificial leather, and fixed to the hindfoot base member 14 by sewing or other means.

As illustrated in FIGS. 1 and 2, the upper body 11 has an ankle opening 20 at its upper end. In a plan view, the ankle opening 20 has a substantially elliptical shape having the major axis extending in the longitudinal direction so as to fit the periphery of the ankle of the wearer. Further, a throat opening 21 extends forward in the longitudinal direction from the front end of the ankle opening 20. The throat opening 21 is continuous with the ankle opening 20 and has a substantially rectangular shape to correspond to the instep of the foot. A tongue 22 is disposed at the throat opening 21. At least the front end of the tongue 22 is fixed to the forefoot base member 12 by sewing or other means.

Decorative eyelet parts 23, 23 extend in the longitudinal direction along the edge of the throat opening 21. Each decorative eyelet part 23 has eyelets 24, 24, . . . penetrating the decorative eyelet part 23. A shoelace 25 is allowed to pass through the eyelets 24, 24, . . . . The decorative eyelet part 23 located closer to the heel is integral with an upper portion of the side-reinforcing part 17.

As illustrated in FIGS. 1 to 4, the upper 10 of the shoe S is provided with the stretchable member 30. In this embodiment, the stretchable member 30 is arranged to correspond to a rear portion in the forefoot F. Specifically, the stretchable member 30 includes a base 31 of which a peripheral edge is fixed to the forefoot base member 12 by sewing or other means. The base 31 will be described later.

The stretchable member 30 includes the base 31, which is flat. The base 31 is made of a knitted fabric which is relatively highly stretchable. Specifically, the base 31 is made of a warp or weft knitted fabric of, for example, an fiber yarn including an elastic thread, and stretchable in the foot width direction of the forefoot F. Examples of the fiber materials for the elastic thread include, but are not particularly limited to, polyurethane-based fiber materials, polyether/ester-based fiber materials, and polyolefin-based fiber materials.

The stretchable member 30 includes limiting parts 32, 32, . . . which are configured to limit stretch of the base 31. Each limiting part 32 is made of a knitted fabric which is less stretchable than the base 31. For example, each limiting part 32 is preferably made of a warp or waft knitted fabric of a non-elastic yarn or thread. Examples of fiber materials for the non-elastic yarn or thread include, but are not limited to: polyester-based fiber materials such as a polyethylene terephthalate fiber material and a polytrimethylen-terephthalate fiber material; polyamide-based fiber materials, polyolefin-based fiber materials such as a polypropylene fiber material; cellulose-based fiber materials such as cupra, rayon, cotton, and bamboo fibers; and animal hair such as wool. In FIGS. 1 to 4, the limiting parts 32, 32, . . . are marked and accentuated with dot hatching.

Figure 3:
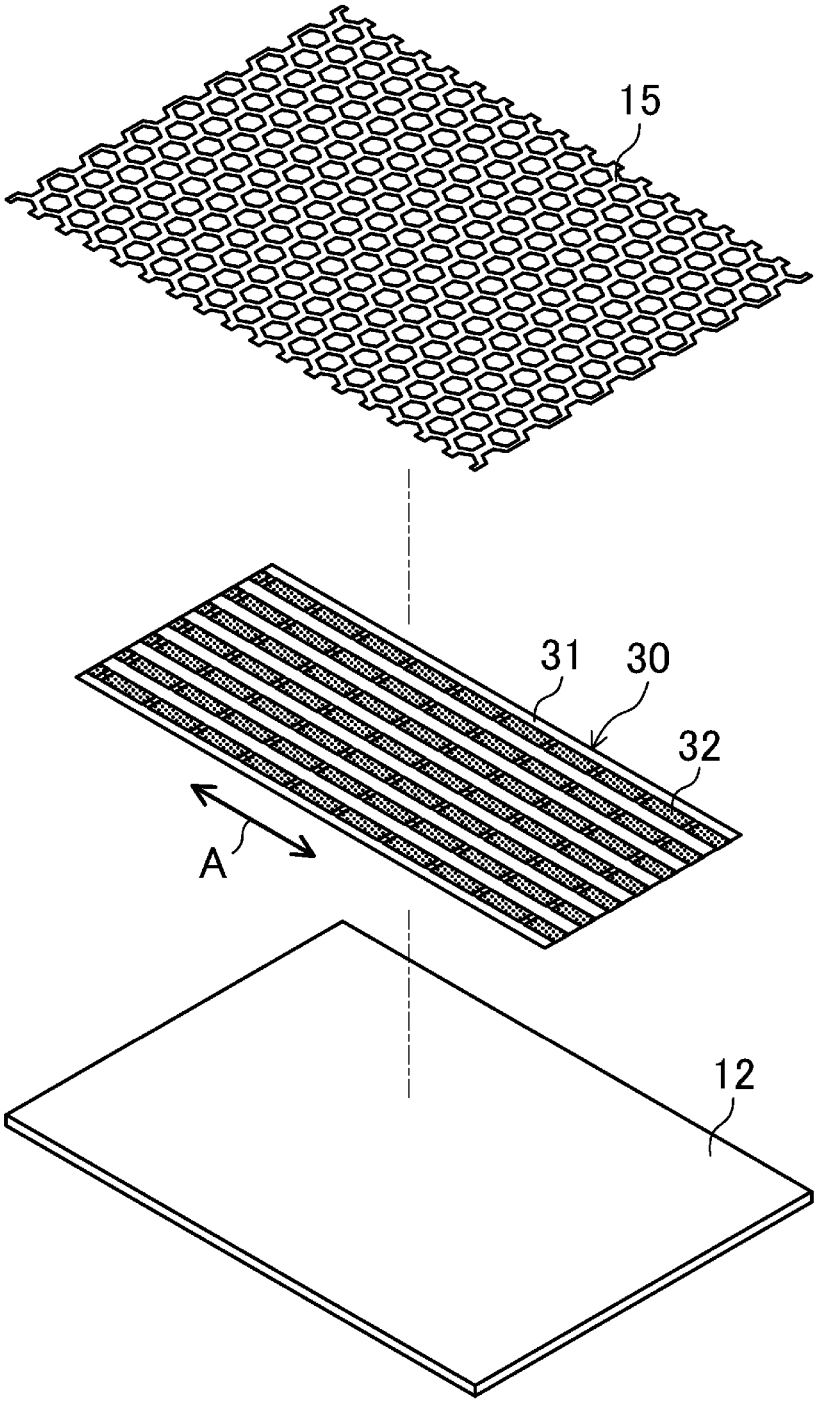
FIG. 3 is an exploded perspective view schematically illustrating the structure of a portion of an upper.
Figure 4:
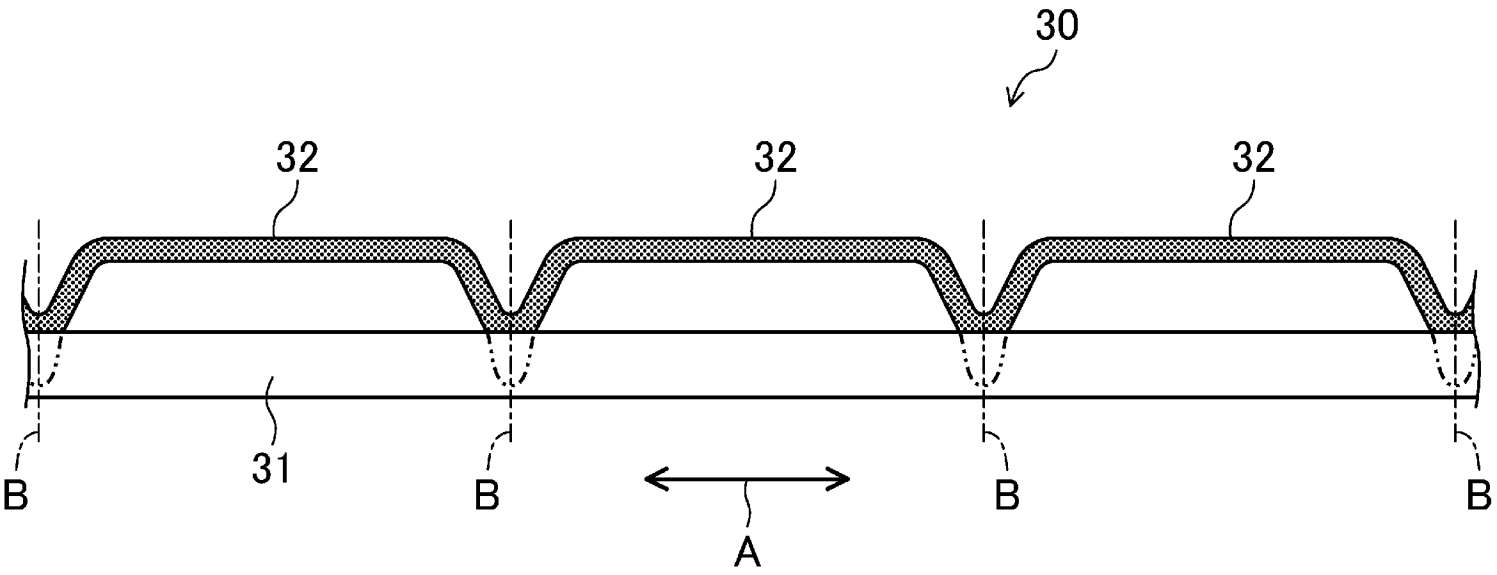
FIG. 4 is a vertical cross-sectional view of a stretchable member in which limiting parts are fixed to a base in an unstretched state.

Each of the limiting parts 32 is made of a plurality of threads knitted into a tape-like shape as viewed in plan, and extends in a stretching direction A of the base 31 (see FIGS. 3 and 4). In other words, each limiting part 32 has a flat band shape. Specifically, it is preferable to form each limiting part 32 to have a width of 1 mm or more, taking into account the gap between a toenail and the underlying skin.

The limiting parts 32 are formed integrally with the base 31. As illustrated in FIG. 4, each limiting part 32 has both ends in its length direction knitted in, and fixed to, the base 31 (see the phantom lines in FIG. 4). Each limiting part 32 is longer than the distance between fixing points B, B at which the limiting part 32 is fixed to the base 31 in an unstretched state. That is, each limiting part 32 is configured to become slack with respect to the base 31 when the base 31 is in the unstretched state. Specifically, it is preferable that the each limiting part 32 is longer than the distance between the fixing points B, B by about 10% to 20% of the distance.

As illustrated in FIG. 4, the ends of each of the plurality of limiting parts 32, 32, . . . are joined to ends of adjacent ones of the plurality of limiting parts 32, 32, . . . at the associated fixing points B at which the plurality of the limiting parts 32, 32, . . . are fixed to the base 31. The plurality of limiting parts 32, 32, . . . , which are thus joined to each other in series, form at least one continuous row in the stretching direction A of the base 31. Note that in FIG. 4, hatching is omitted from the cross section of the base 31 to show joined portion of the base 31 and the limiting parts 32, 32, . . . at the fixing points B (see the phantom lines).

Further, as illustrated in FIGS. 1 to 3, the plurality of limiting parts 32, 32, . . . form two or more rows, which are arranged side by side at intervals in a direction perpendicular to the stretching direction A of the base 31.

Advantages of Embodiment

As can be seen from the foregoing, each limiting part 32 is longer than the distance between the fixing points B, B at which the limiting part 32 is fixed to the base 31 in an unstretched state, and is configured to become slack with respect to the base 31 when the base 31 is in the unstretched state. That is, the limiting parts 32 permit the base 31 to stretch by a predetermined amount from the unstretched state. As a result, when a wearer puts on the shoes S of which the upper 10 includes the stretchable member 30, the base 31 stretches by the predetermined amount from the unstretched state. This makes it easy for the shoes S to fit the feet of the wearer. On the other hand, the limiting parts 32 limit the stretch of the base 31. As a result, the feet are not allowed to move or slide excessively inside the shoes S and are kept held in the shoes S. The limiting parts 32 are each made of a knitted fabric having a flat band shape and are formed integrally with the base 31. This configuration makes it less likely that the limiting parts 32 are caught on obstacles and the like, and increases the tensile stress of the stretchable member 31. Thus, the limiting parts 32 are kept slack with respect to the base 31 in the unstretched state, resulting in that the stretchable member 30 enables the shoes S to maintain the fitting properties. In addition, the limiting parts 32 strongly limit the stretch of the base 31, resulting in that the stretchable member 30 enables the shoes to have improved holding properties. Therefore, the stretchable member 30 according to this embodiment of the present disclosure can improve the fitting properties and the holding properties of the shoes S.

Each limiting part 32 has a width of 1 mm or more. Specifically, each limiting part 32 is designed to have a width equal to or greater than a gap between a toenail and the underlying skin. This configuration substantially prevents each limiting part 32 from entering between a toenail and the underlying skin, and increase the tensile stress of the stretchable member 30 sufficiently.

The ends of each of the plurality of limiting parts 32, 32, . . . are joined to ends of adjacent ones of the plurality of limiting parts 32, 32, . . . at the associated fixing points B at which the plurality of limiting parts 32, 32, . . . are fixed to the base 31. The plurality of limiting parts 32, 32, . . . , which are thus joined to each other in series, form at least one continuous row in the stretching direction A of the base 31. This configuration can increase tensile stress of the stretchable member 30 uniformly in the stretching direction A.

Further, the at least one row of the plurality of limiting parts 32, 32, . . . includes a plurality of rows of the plurality of limiting parts 32, 32, . . . , and the plurality of rows are arranged side by side at intervals in a direction perpendicular to the stretching direction A of the base 31. Thanks to this configuration, portions of the base 31 between the rows of the limiting parts 32, 32, . . . can stretch also in the direction perpendicular to the stretching direction A of the base 31, without being limited by the limiting parts 32, 32, . . . . Thus, this configuration contributes to further improvement of the fitting properties of the shoes S.

Each of the limiting parts 32 is made of a knitted fabric which is less stretchable than the base 31. This makes it possible to increase the tensile stress of the limiting part 32 relative to that of the base 31. As a result, the limiting parts 32 can reliably limit the stretch of the base 31.

The stretchable member 30 is arranged to correspond to a rear portion in the forefoot F of the upper. In this configuration, the fitting properties and the holding properties of the shoe S can bring about their effect to the rear portion in the forefoot F in a concentrated manner.

First Variation of Embodiment

Figure 5:
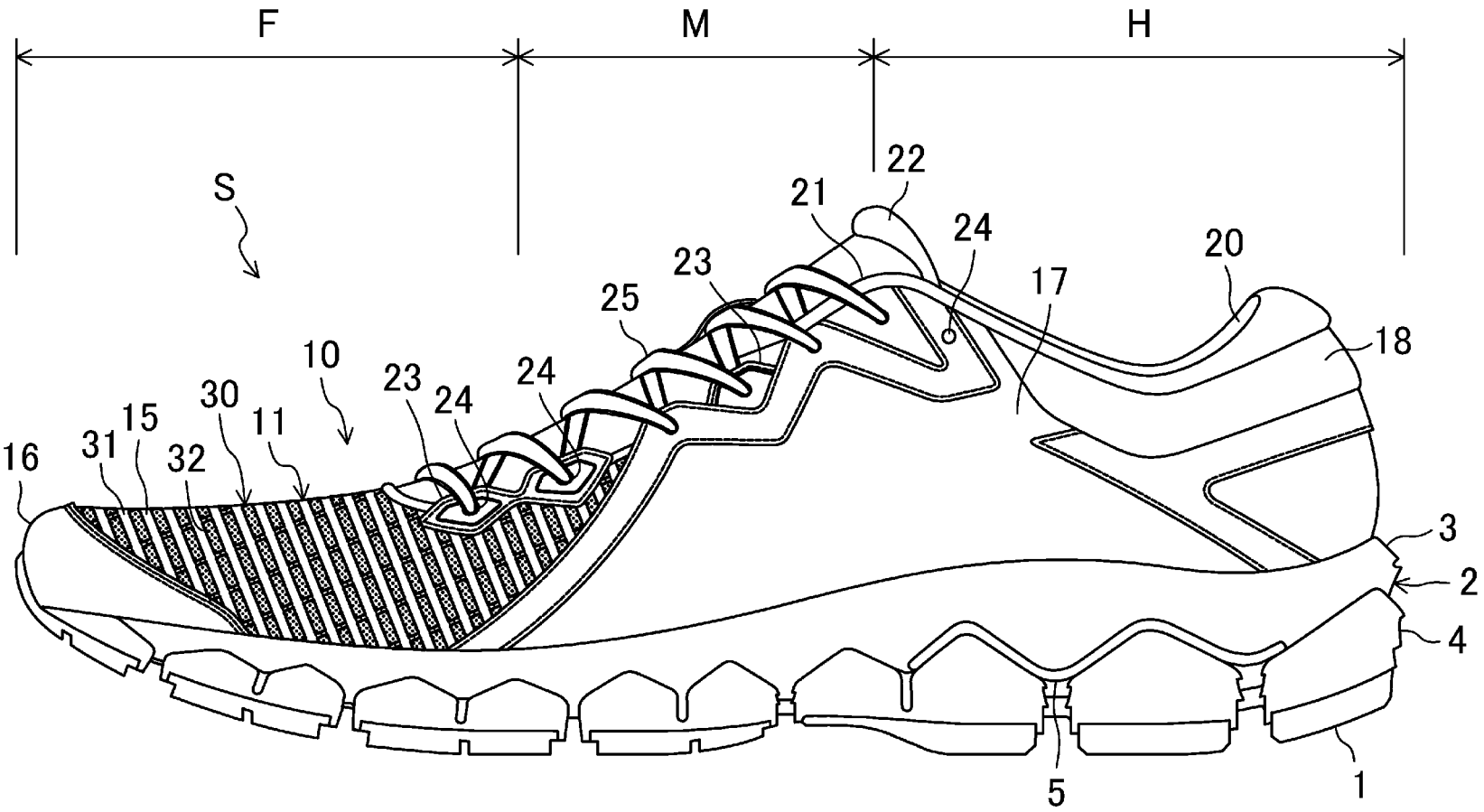
FIG. 5 corresponds to FIG. 1, and illustrates a shoe according to a first variation, as viewed from the lateral side.
Figure 6:
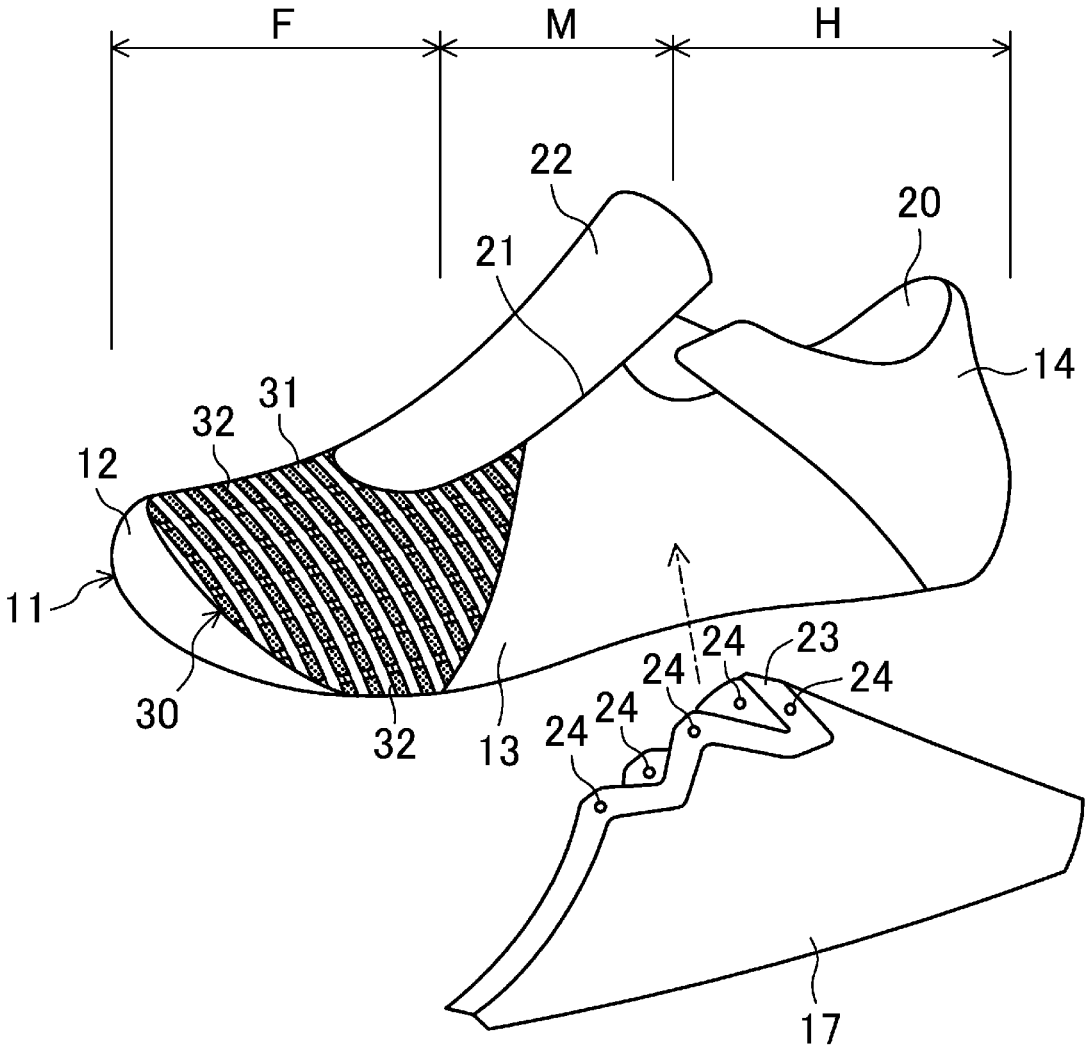
FIG. 6 corresponds to FIG. 2, and illustrates the structure of a portion of an upper of the first variation.

In the embodiment described above, the stretchable member 30 is arranged in the rear portion in the forefoot F of the upper. However, this is merely a non-limiting example. For example, as illustrated in FIGS. 5 and 6, the stretchable member 30 may be arranged to cover the entire area of the forefoot F of the upper. Specifically, in the configuration of this variation, the peripheral edge of the stretchable member 30 is fixed to the periphery edge of the forefoot base member 12 by sewing or other means. In the configuration of this variation, the fitting properties and the holding properties of the shoe S can bring about their effect to the entire area of the forefoot F in a concentrated manner. In this variation, no exterior member 15 is provided, and the stretchable member 30 is exposed at the outer surface. However, this is merely a non-limiting example. An exterior member 15 may be overlaid on or above the stretchable member 30.

Second Variation of Embodiment

Figure 7:
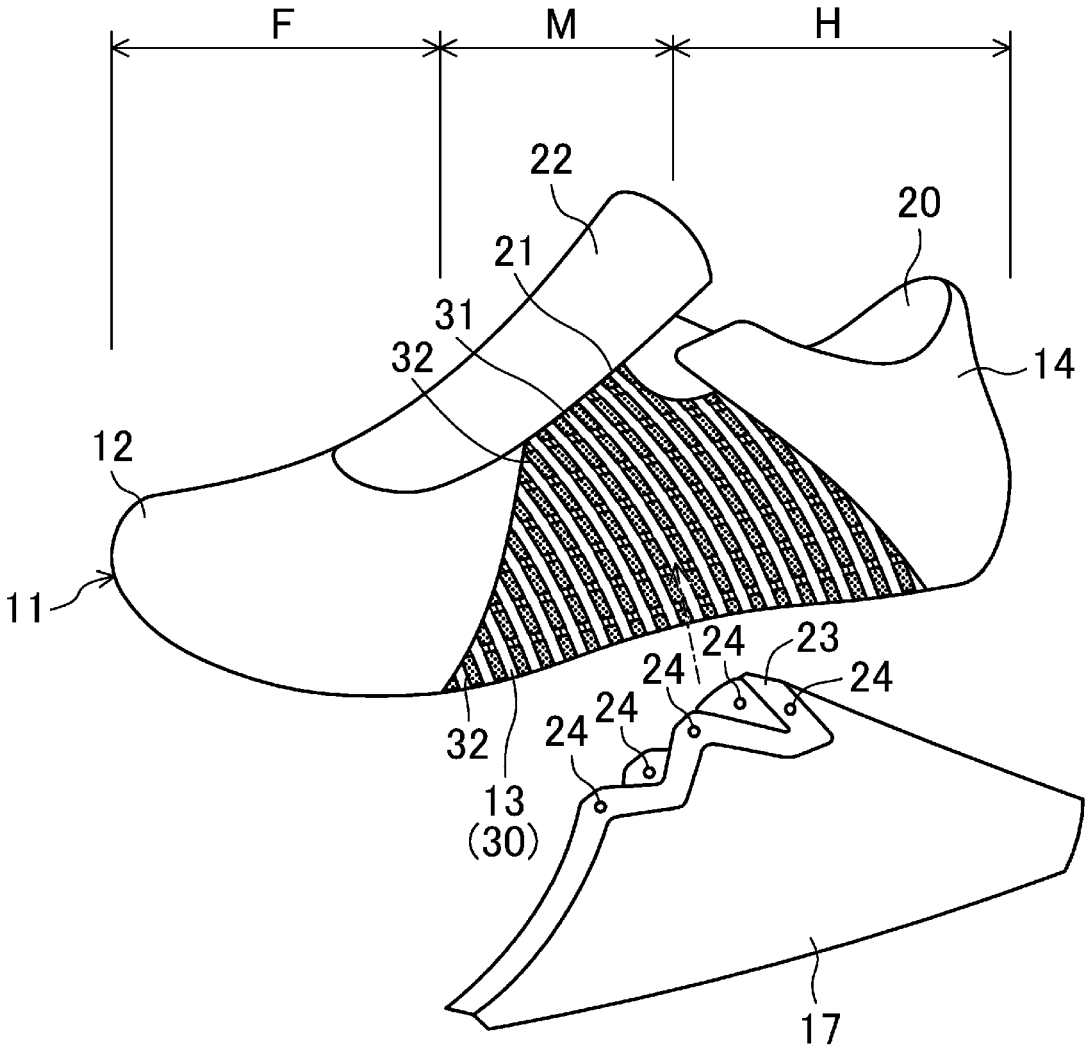
FIG. 7 corresponds to FIG. 2, and illustrates the structure of a portion of an upper of a second variation.

As illustrated in FIG. 7, the stretchable member 30 may be arranged to mainly correspond to the midfoot M, for example. Specifically, in the configuration of this variation, the midfoot base member 13 is configured as a stretchable member 30, and the peripheral edge of the stretchable member 30 is fixed to the forefoot base member 12, the hindfoot base member 14, and the tongue 22 by sewing or other means. In the configuration of this variation, the fitting properties and the holding properties of the shoe S bring about their effect to the midfoot M in a concentrated manner.

Other Embodiments

Figure 8:
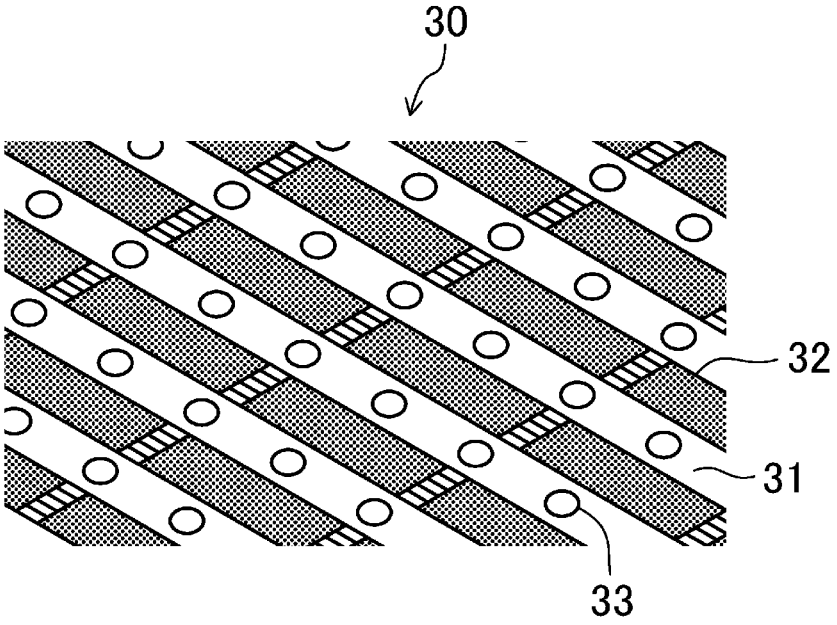
FIG. 8 is a perspective view illustrating, on an enlarged scale, a portion of a stretchable member according to another embodiment.

The stretchable member 30 of the embodiment described above may have a plurality of holes 33, 33, . . . formed in the base 31, as illustrated in FIG. 8. The holes 33, 33, . . . are spaced apart from each other, penetrate the base 31, and are deformable in the stretching direction A in accordance with the stretch and contraction of the base 31. These holes 33, 33, . . . facilitate the stretch of the base 31, and contribute to further improvement of the fitting properties of the shoe S. The holes 33, 33, . . . may have a visible size, or a size which is so small as to be invisible.

The stretchable member 30 of the embodiment described above includes the plurality of limiting parts 32, 32, . . . . However, this is merely a non-limiting example. The stretchable member 30 may include only one limiting part 32 with respect to one base 31.

The stretchable member 30 of the embodiment described above includes the plurality of rows of the plurality of limiting parts 32, 32, . . . . However, this is merely a non-limiting example. The stretchable member 30 may include only a single row of the plurality of limiting parts 32, 32, . . . .

The stretchable member 30 of the embodiment described above includes the limiting parts 32 which are less stretchable than the base 31. However, this is merely a non-limiting example. Specifically, the limiting parts 32 may be made of a knitted fabric which is substantially as stretchable as the base 31.

Note that the present disclosure is not limited to the embodiment described above, and various changes and modifications may be made without departing from the scope of the present disclosure.

The present disclosure is industrially applicable to, for example, a stretchable member for athletic shoes for walking, running, and various sports, sneakers for daily use, or rehabilitation shoes and to shoes including the stretchable member.

What is claimed is:

1. A stretchable member for a shoe, the stretchable member being usable in an upper of the shoe and comprising:

a flat base made of a stretchable knitted fabric; and a limiting part extending in a stretching direction of the base, formed integrally with the base while having both ends in a length direction knitted in, and fixed to, the base, and configured to limit stretch of the base, wherein the limiting part is longer than a distance between fixing points at which the limiting part is fixed to the base in an unstretched state, and is made of a knitted fabric which has a flat band shape and which is configured to become slack with respect to the base when the base is in the unstretched state, the limiting part comprises a plurality of limiting parts, and ends of each of the plurality of limiting parts are joined to ends of adjacent ones of the plurality of limiting parts at associated ones of the fixing points at which the plurality of limiting parts are fixed to the base, such that the plurality of limiting parts, which are joined to each other in series, form at least one continuous row in the stretching direction of the base.

2. The stretchable member of claim 1, wherein the limiting part has a width of 1 mm or more.

3. The stretchable member of claim 1, wherein the at least one row of the plurality of limiting parts comprise a plurality of rows of the plurality of limiting parts, and the plurality of rows of the plurality of limiting parts are arranged side by side at intervals in a direction perpendicular to the stretching direction of the base.

4. The stretchable member of claim 1, wherein the limiting part is made of a knitted fabric which is less stretchable than the base.

5. The stretchable member of claim 1, wherein a plurality of holes which are deformable in accordance with the stretch and contraction of the base are formed to be spaced apart from each other in the base.

6. A shoe including the stretchable member of claim 1 arranged in a portion, of the upper, corresponding to a forefoot of a wearer.

7. A shoe including the stretchable member of claim 2 arranged in a portion, of the upper, corresponding to a forefoot of a wearer.

8. A shoe including the stretchable member of claim 3 arranged in a portion, of the upper, corresponding to a forefoot of a wearer.

9. A shoe including the stretchable member of claim 4 arranged in a portion, of the upper, corresponding to a forefoot of a wearer.

10. A shoe including the stretchable member of claim 5 arranged in a portion, of the upper, corresponding to a forefoot of a wearer.

11. A shoe including the stretchable member of claim 1 arranged in a portion, of the upper, corresponding to a midfoot of a wearer.

12. A shoe including the stretchable member of claim 2 arranged in a portion, of the upper, corresponding to a midfoot of a wearer.

13. A shoe including the stretchable member of claim 3 arranged in a portion, of the upper, corresponding to a midfoot of a wearer.

14. A shoe including the stretchable member of claim 4 arranged in a portion, of the upper, corresponding to a midfoot of a wearer.

15. A shoe including the stretchable member of claim 5 arranged in a portion, of the upper, corresponding to a midfoot of a wearer.

* * * * *